US005664874A

United States Patent [19]

Winterer

[11] Patent Number: 5,664,874

[45] Date of Patent: Sep. 9, 1997

[54] BARRICADE WARNING LIGHT

[76] Inventor: Allen G. Winterer, 126 Jeranios Ct., Thousand Oaks, Calif. 91362

[21] Appl. No.: 581,180

[22] Filed: Dec. 29, 1995

[51] Int. Cl.[6] ..... F21L 7/00

[52] U.S. Cl. ..... 362/191; 340/908.1; 362/184; 362/196; 362/200; 362/802; 362/376

[58] Field of Search ..... 362/183, 184, 362/190, 191, 196, 200, 157, 376, 802; 340/908.1

[56] References Cited

U.S. PATENT DOCUMENTS

| | | | |
|---|---|---|---|
| 2,981,827 | 4/1961 | Orsatti et al. | 340/908.1 |
| 3,264,461 | 8/1966 | Osburn | 362/196 |
| 3,500,378 | 3/1970 | Pickering et al. | 340/908.1 |
| 4,069,404 | 1/1978 | Minoprio et al. | 362/200 |
| 4,296,460 | 10/1981 | Minoprio et al. | 362/200 |
| 4,343,032 | 8/1982 | Schwartz | 362/802 |
| 4,482,941 | 11/1984 | Linder | 362/191 |
| 4,751,622 | 6/1988 | Williams | 362/183 |
| 5,490,045 | 2/1996 | Linder | 340/908.1 |

*Primary Examiner*—Carroll B. Dority
*Attorney, Agent, or Firm*—Ellsworth R. Roston

[57] ABSTRACT

In a barricade warning light, a first casing formed from two (2) mated halves provides a detachable enclosure, inaccessible (except by a special key) before detachment of a second casing holding batteries replaceable with the casings detached. A mounting rod assembly extends from the first casing for attachment to a barricade. An electronic module holds a photocell, an LED and circuitry energizing the LED when the photocell detects darkness. The first casing has a (a) first opening for coupling the key to a switch controlling the warning light operation, (b) second opening for key insertion to couple (decouple) the first casing to (from) the mounting rod assembly and (c) third opening for key insertion to couple (decouple) the casings. With the casings decoupled, (a) the electronic module may be assembled (disassembled) to (from) the first casing and (b) a base plate is attachable (separable) to (from) the bottom of the first casing. When energized, each LED directs light to the center optical area of a conically shaped lens. One surface of each lens defines a lens system including a Fresnel lens for producing a cone of light with a short axis and the other surface defines pillow lenses for converting such light to a slightly divergent pattern. Each lens has retroreflective material at its peripheries and its corners for reflecting light as from automobile headlights. The warning light may consist of a single unidirectional lens unit or a bi-directional unit formed from a pair of LED's and a pair of back-to-back conically shaped lenses.

46 Claims, 8 Drawing Sheets

BARRICADE WARNING LIGHT

This invention relates to a barricade warning light. More particularly, the invention relates to a barricade warning light in which the components in the warning light are accessible only to authorized personnel and in which only the required wavelength of light is efficiently produced, transmitted and projected to meet the requirement of the application. This is achieved with low power consumption.

This invention resolves long standing issues by providing extended operating life, secure but easy access for field or shop maintenance, secure/easy field installation to standard barricade assemblies, major reduction in waste battery disposal volumes and optional solar power.

BACKGROUND OF THE INVENTION

Barricades are often provided in city streets to divert traffic. For example, barricades may be provided in city streets when there are potholes in the streets or when there are other impediments blocking the flow of traffic in such streets. Such barricades are dangerous unless they are identified to approaching traffic in some visible way. The danger is significantly increased at night because the visibility ahead of the approaching car is decreased.

Barricade warning lights are generally provided in front of the barricades to warn approaching traffic of such barricades. The barricade warning lights are generally mounted on the barricades so that the lights are raised a specified distance from the ground. Such barricade warning lights have been used for decades. They generally include a photocell for sensing the onset of nighttime and of daytime. A light in the assembly then becomes illuminated, either on a continuous or a flashing basis, during the period in which darkness occurs.

The barricade lights now in use have certain significant disadvantages. They are inefficient in producing and transmitting the amber light whose purpose is to warn approaching vehicles. They suffer outdated optical designs. They include limited life incandescent lamps which consume excessive power in producing an abundance of broad spectrum light, a large measure of which is subsequently wasted by filtering this spectrum to emit the amber wavelength needed in the application. The incandescent lamps now in use radiate their power radially. This causes additional loss of energy. The barricade lights now in use are also subject to lamp filament failure due to mechanical shock in a typical roadway, repair and construction setting.

Present barricade lights utilize two large "lantern batteries" which demonstrate comparable though somewhat shorter operating longevities in comparison to the batteries used in invention. These batteries in the barricade lights now in use are housed in a typically plastic enclosure secured and affixed to the barricade by a relatively large bolt whose head bears a specialized configuration not operable by other than a rather large and bulky wrenchlike implement. Field maintenance and/or replacement of heavy, bulky batteries or the incandescent lamp requires this specialized wrench to be available and to be utilized in a time consuming procedure. Excessive time by the maintenance staff in maintenance during field operations increases exposure to traffic related accidents and injuries.

Therefore there is not only a significant cost and a considerable safety risk associated with field battery replacement (maintenance) of the present devices but the "special wrench" is needed to remove the device from the barricade prior to beginning any maintenance procedure. Once removed, the disassembly of the battery case to replace batteries requires more items to be disassembled than two hands can hold, resulting in dropped and lost parts. As a result, in a majority of cases, field maintenance is avoided and the entire barricade/warning light assembly is retrieved and returned to the shop any service, maintenance and repair. The result is that 20% or more of the warning light in the field are inoperable due to inadequate or no service. A common solution is to place an excessive number of warning lights on a job site to compensate for the high percentage of inoperable units.

Current products are relatively large and bulky and have an odd shape which does not permit stacking or easy storage. The current usage of the traditional older Lantern Battery technology also results in significant disposal in landfills of volumes of potentially hazardous and undesirable battery materials. Furthermore, a variety of externally accessible fasteners is typically used to assemble portions of the currently available products. Because of this, they provide a temptation to mischievous or ill intentioned people to tamper with the lights. This often further limits the longevity of the lights.

The problems discussed above have existed for decades without any significant improvement in such lights. Considerable efforts have been made, and significant amounts of money have been spent, to provide a barricade warning light which overcomes the above difficulties. In spite of this, the same problems still persist.

BRIEF DESCRIPTION OF THE INVENTION

This invention provides a barricade warning light which overcomes the above difficulties. The warning light provides an efficient and high transmission of light with a low consumption of power. It is relatively light, stackable and compact. It has no externally accessible fastener and is accessible only via a special key to authorized people, provides exterior operational and maintenance control and provides for easy field or shop maintenance or repairs. Because of its design features, it is substantially tamperproof.

In a barricade warning light constituting one embodiment of the invention, a first casing formed from two (2) mated halves provides a detachable enclosure, inaccessible (except by a special key) before detachment of a second casing holding batteries replaceable with the casings detached. A mounting rod assembly extends from the first casing for attachment to a barricade. An electronic module holds a photocell, an LED and circuitry energizing the LED when the photocell detects darkness.

The first casing has a (a) first opening for coupling the key to a switch controlling the warning light operation, (b) second opening for key insertion to couple (decouple) the first casing to (from) the mounting rod assembly and (c) third opening for key insertion to couple (decouple) the casings. With the casings decoupled, (a) the electronic module may be assembled (disassembled) to (from) the first casing and (b) a base plate is attachable (separable) to (from) the bottom of the first casing.

When energized, each LED directs light to the center optical area of a conically shaped lens. One surface of each lens defines a lens system including a Fresnel lens for producing a cone of light with a short axis and the other surface defines pillow lenses for converting such light to a slightly divergent pattern. Each lens has retroreflective material at its peripheries and its corners for reflecting light as from automobile headlights. The warning light may consist of a single unidirectional lens unit or a bi-directional unit formed from a pair of LED's and a pair of back-to-back conically shaped lenses.

DETAILED DESCRIPTION OF THE INVENTION

Figure 1:
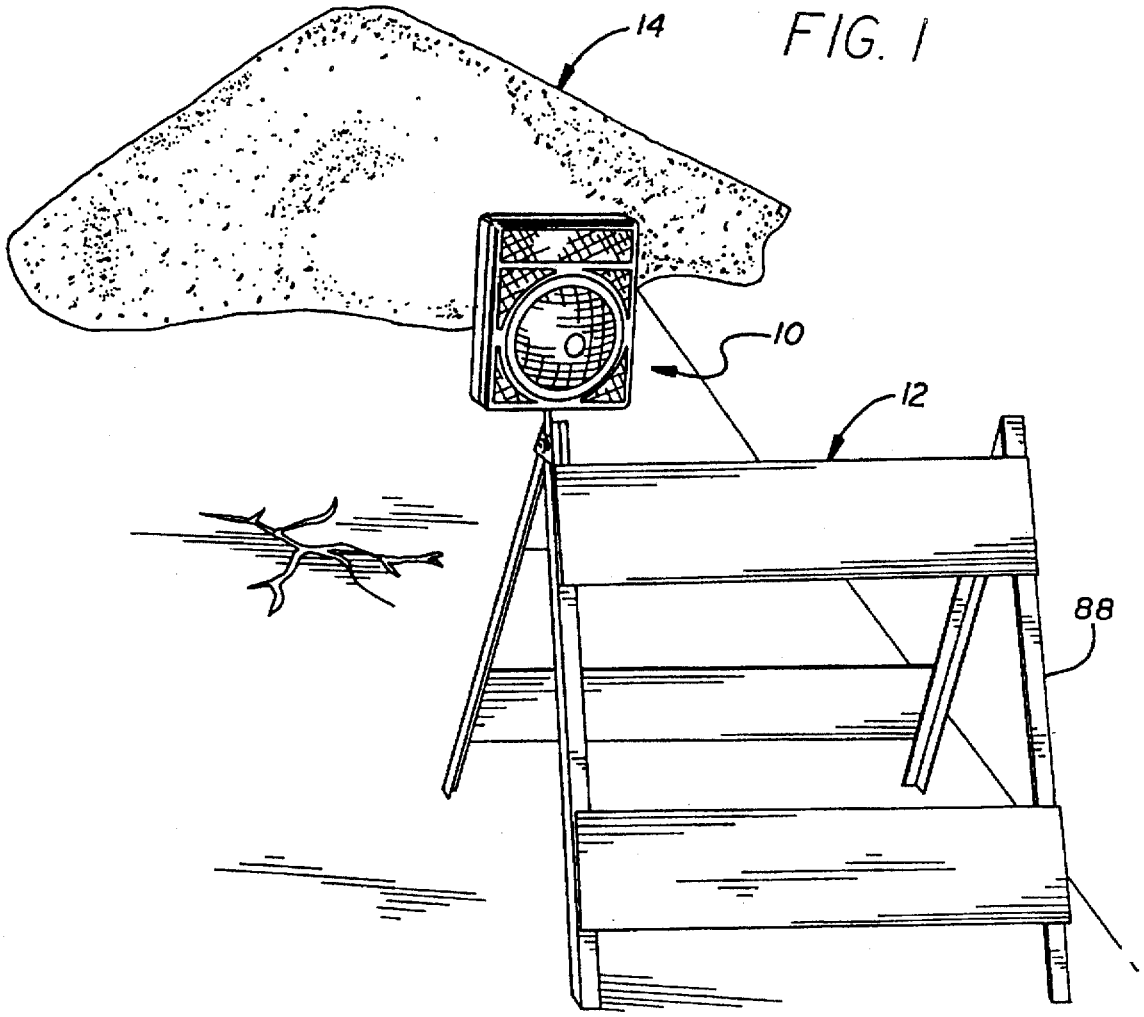
FIG. 1 is a schematic perspective view of a barricade warning light constituting one embodiment of the invention when the barricade warning light is disposed on a suitable barricade to warn of an impediment in a road.
Figure 6:
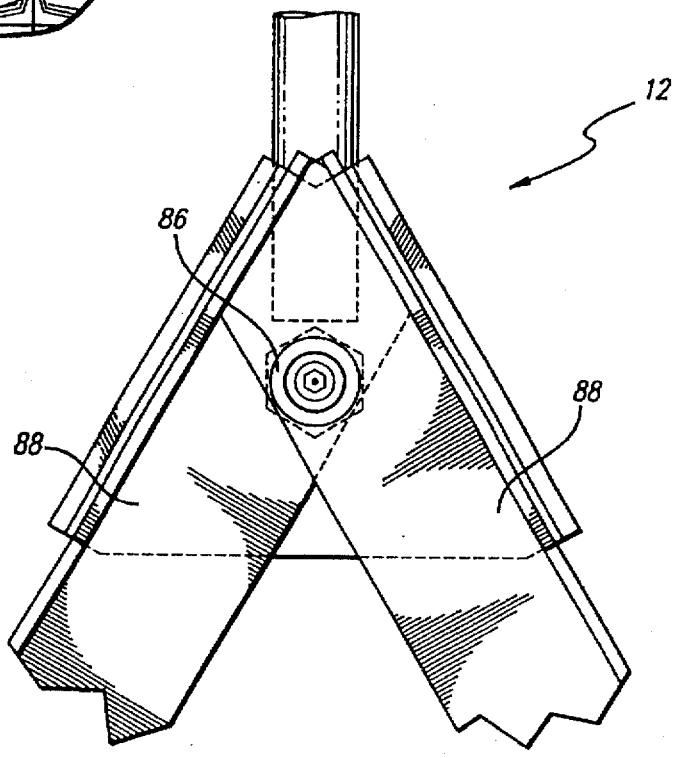
FIG. 6 is an enlarged fragmentary view taken substantially on the line 6—6 in FIG. 2 and illustrates one embodiment of an arrangement for holding the barricade warning light in operating position on a standard barricade.

Apparatus is generally indicated at 10 (FIG. 1) for providing a barricade warning light. The barricade warning light 10 is generally disposed on a suitable barricade generally indicated at 12 (FIGS. 1 and 6) to raise the warning light from the ground. The barricade warning light 10 is generally disposed in a road in front of, or to one side, of an impediment 14 such as a serious hole or other damage in the road or a pile of debris on the road to warn approaching traffic of such impediment. It will be appreciated, however, that the barricade warning light 10 may be disposed in fields or walking paths to warn walkers or runners of impediments such as holes or ditches. It will also be appreciated that barricade warning lights have a significantly greater range of uses than are specified above.

The barricade warning light 10 includes a matched pair of casings generally indicated at 18 and 20 (FIGS. 3 and 7), the casing 20 providing a housing for batteries. The casings 18 and 20 are adapted to be removably coupled to each other. When coupled, the casings 18 and 20 are accessible only to authorized personnel and only from positions external to the casing.

Figure 2:
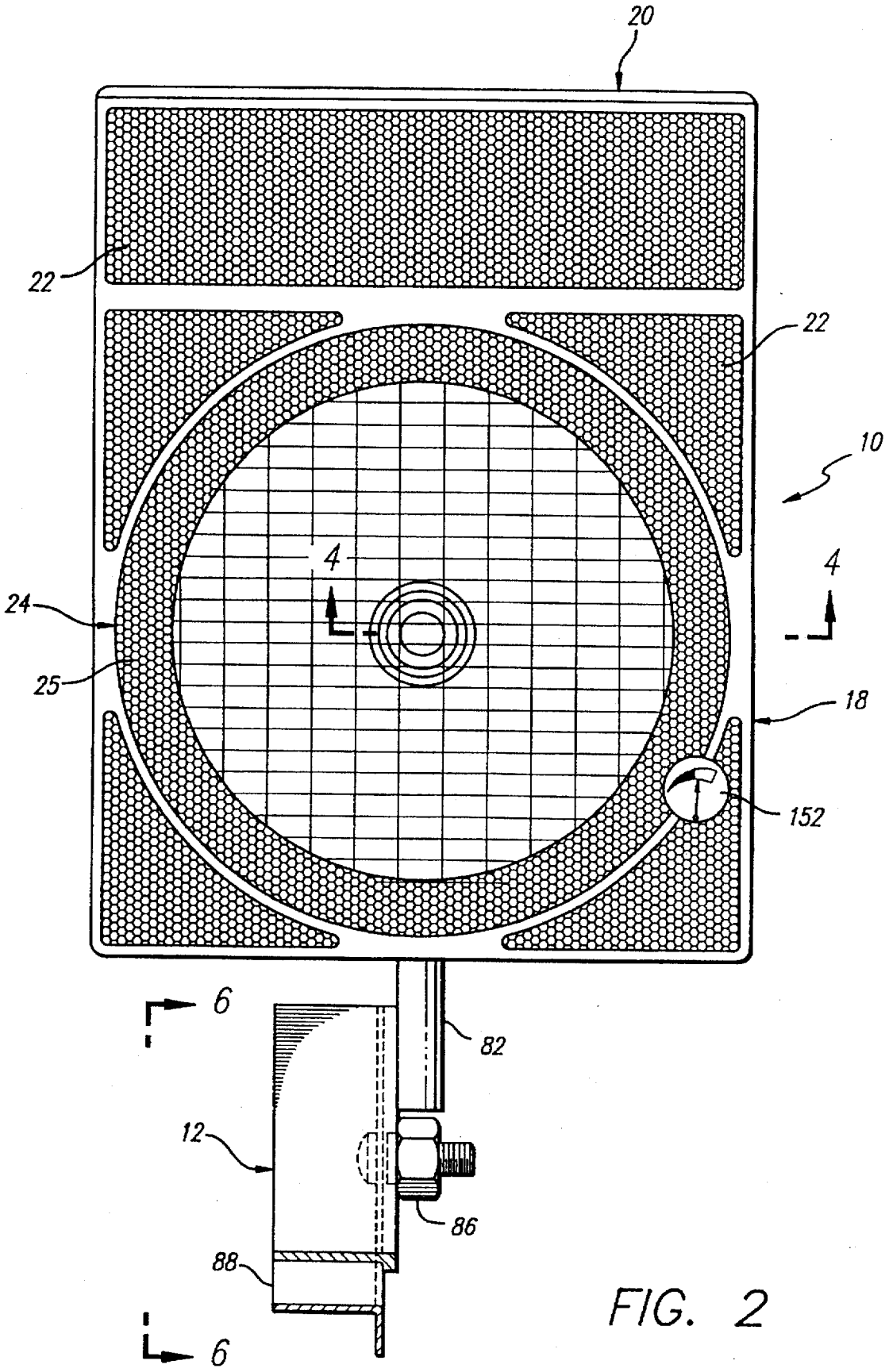
FIG. 2 is a front elevational view of the barricade warning light.

The casings 18 and 20 include retroreflective material 22 (FIG. 2), preferably of an amber color, on substantially all of their periphery except for a centrally located annular region where a pair of lenses generally indicated at 24 are disposed inside of, or may be an integral part of, the casing. The retroreflective material 22 is well known in the art. It provides a reflection to oncoming cars of the light directed from the headlights of such cars to the barricade warning light 10. The retroreflective material 22 may be disposed at the corners of the casing 18.

The disposition of the retroreflective material 22 in the warning light 10 occupies a significantly greater area than in the warning lights of the prior art. Because of this, the retroreflective material 22 in the warning light 10 is significantly more effective than the retroreflective material in the warning lights of the prior art. The retroreflective material 22 may also be disposed as at 25 on the annular periphery of each of the lenses 24.

Figure 9:
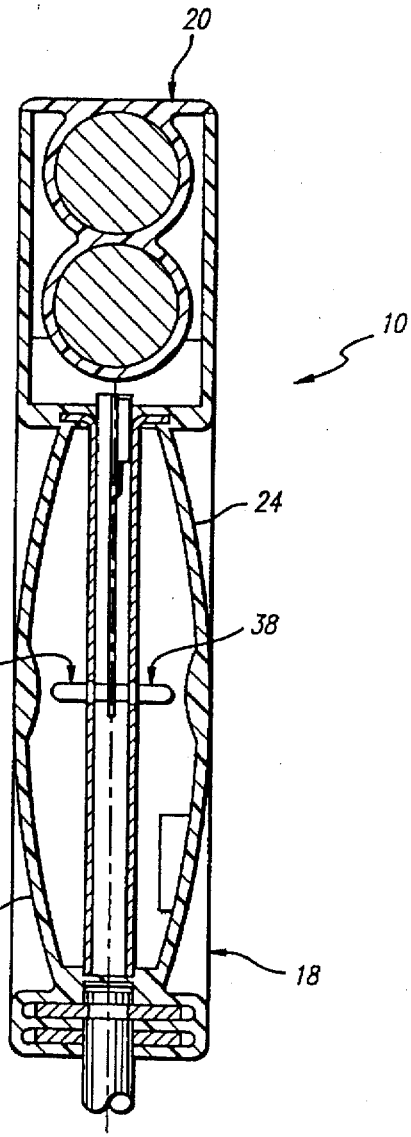
FIG. 9 is a side elevational view in section of the barricade warning light showing an alternative battery retention and an identified parting line of the mated first casing halves.

Each of the lenses 24 may have an annular periphery and a substantially conical cross-sectional shape in an axial direction. The diameter of each of the lenses 22 may illustratively be approximately five inches (5"). The lenses 22 may be provided with a conical configuration and may be disposed in a back-to-back relationship (FIG. 9) in the axial direction with their conical axes substantially aligned with each other. The inner surface (the surface facing the other lens) of each of the lenses 24 is provided with alternately disposed annular ridges 28 and grooves 30 (FIG. 4) to define a Fresnel lens. The Fresnel lens causes light to converge in a conical path and focus in a relatively short distance in a direction away from the barricade warning light 10.

Figure 4:
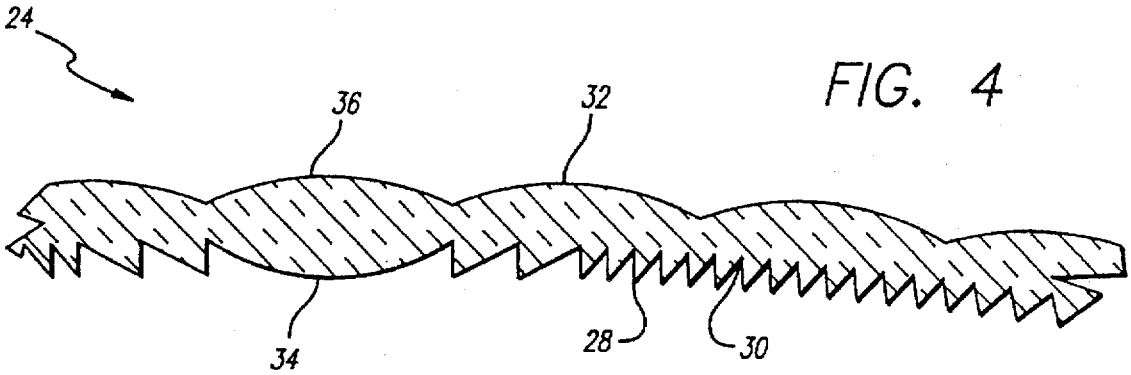
FIG. 4 is a fragmentary sectional view of a lens in the barricade warning light and is taken substantially on the line 4—4 of FIG. 2.
Figure 11:
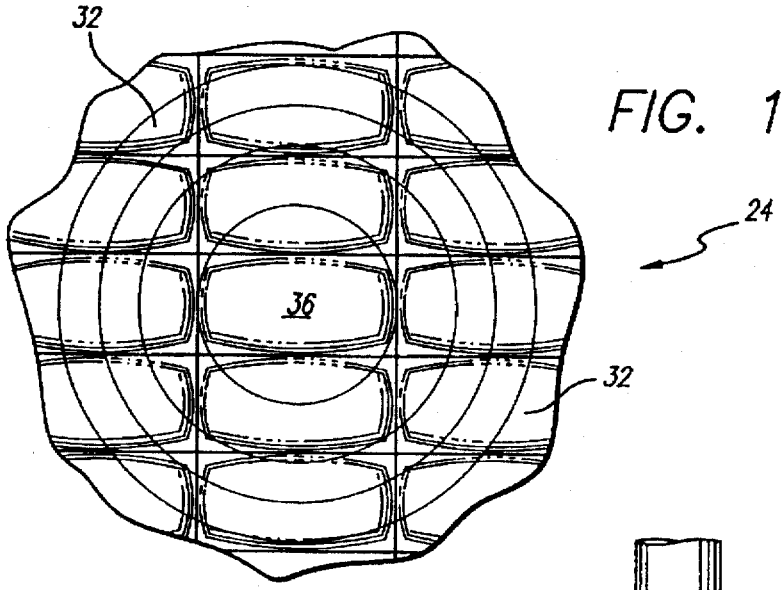
FIG. 11 is a fragmentary side elevational view of the lens shown in FIG. 4 and shows the lens in additional detail.

The outer surface of each of the lenses 24 is shaped to define a plurality of pillow lenses 32 (FIG. 4). Each of the pillow lenses 32 has a smooth surface and has a ratio of nine (9) units in dimensional length and five (5) units in dimensional height. For example, the length of each pillow may be approximately one half inch (½") and the height of each lens may be slightly less than five sixteenth of an inch (5/16"). The surface of each pillow lens 32 acts to receive the light from the Fresnel lens and to redirect the light in a pattern suitable for the application. The rays from each pillow lens may illustratively diverge from the horizontal at an angle of approximately plus or minus nine degrees (±9°) and may illustratively diverge from the vertical at an angle of approximately plus or minus five degrees (±5°).

The center of each of the lenses 24 may be provided with a smooth bulbous configuration 34 of a specific design. The bulbous configuration 34 may be provided with a suitable diameter such as approximately one inch (1"). The bulbous configuration 34 on each of the lenses 24 may have an outwardly convex disposition. A pillow lens 36 with substantially the same dimensions as the pillow lenses 32 may be disposed in the bulbous configuration in each of the lenses 24.

Light-emitting diode(s) (FIGS. 3, 5 and 9) generally indicated at 38 may be disposed between the lenses 32. The light emitting and transmitting characteristics of each of the diodes 38 may be matched to the optical characteristics of an associated one of the lenses 24 and to the wavelength requirements of the application. Each of the diodes 38 may be positioned to direct light to the center of the associated one of the bulbous-shaped configurations 34 (FIG. 4).

Figure 5:
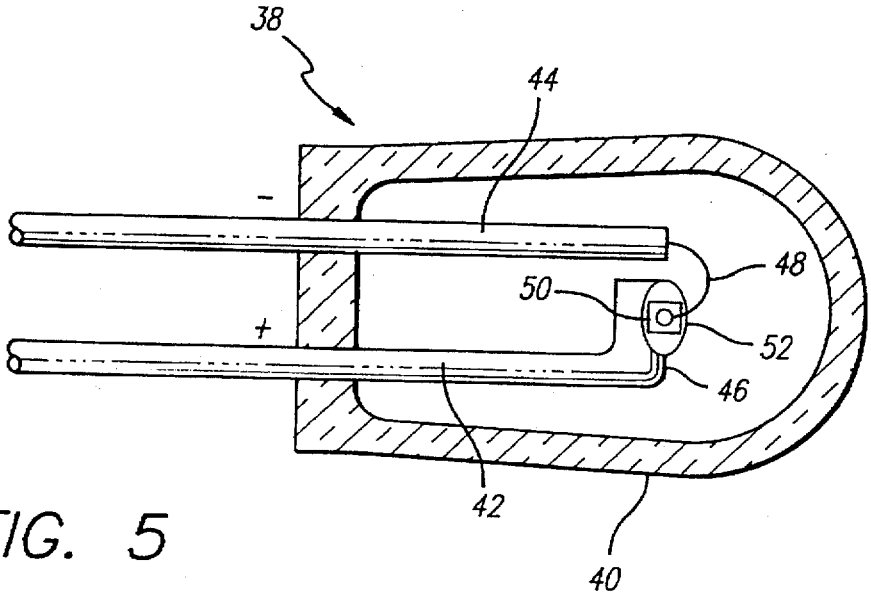
FIG. 5 is an enlarged view, partially in section, of the construction of a light emitting diode included in the barricade warning light.

One of the light emitting diodes 38 is shown schematically in FIG. 5. It includes a lensed envelope 40, a positive terminal 42 inside the envelope and a negative terminal 44 inside the envelope. Leads 48 extend from the terminal 44 to the LED chip 49. The LED chip 49 is disposed on a concave platform 52 so as to be centered in the lensed envelope 40.

Figure 3:
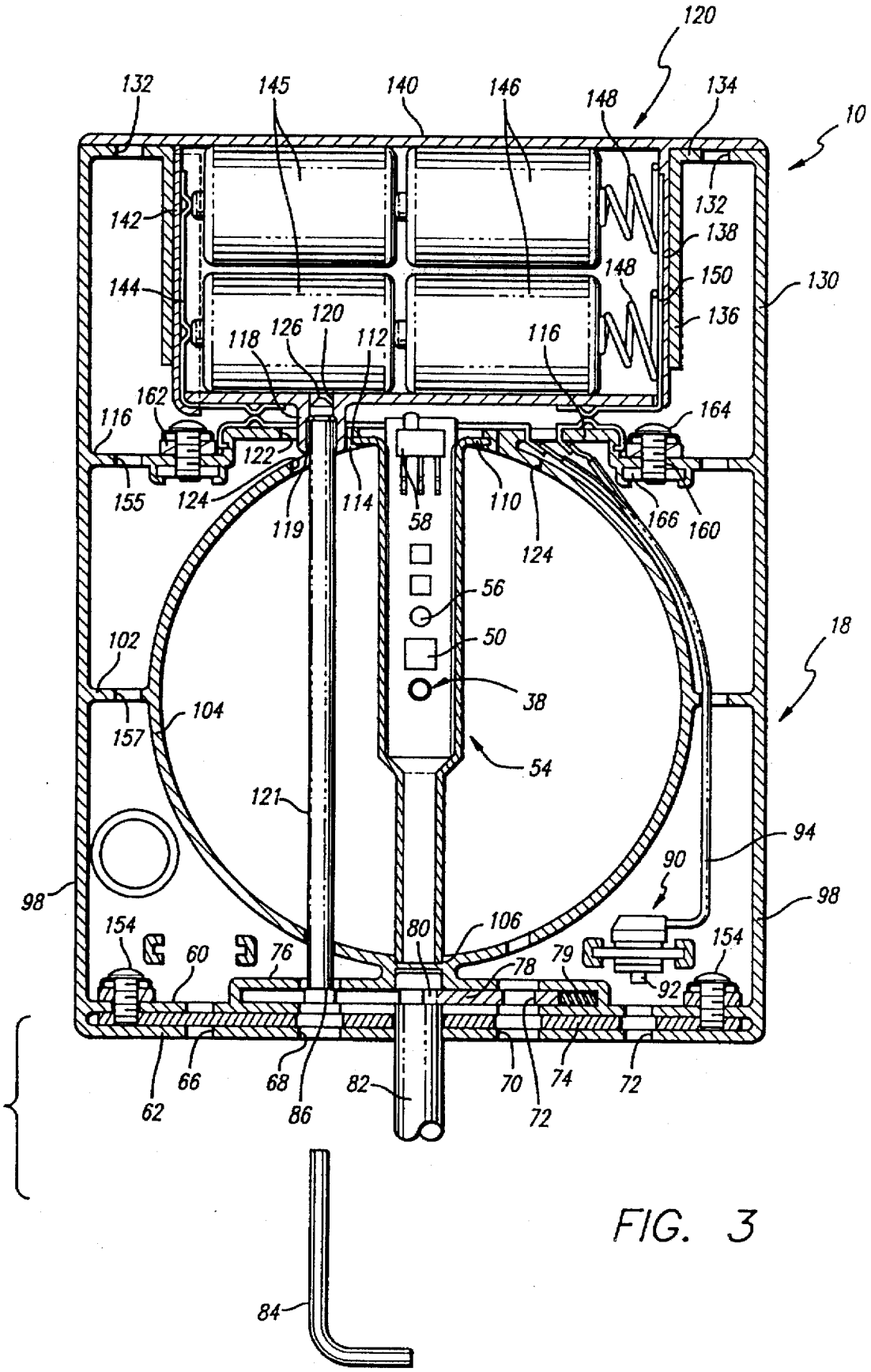
FIG. 3 is taken substantially on the line 3—3 of FIG. 1 and is a sectional view of the barricade warning light and also shows a key for performing certain functions in the barricade warning light from a position external to the barricade warning light.
Figure 7:
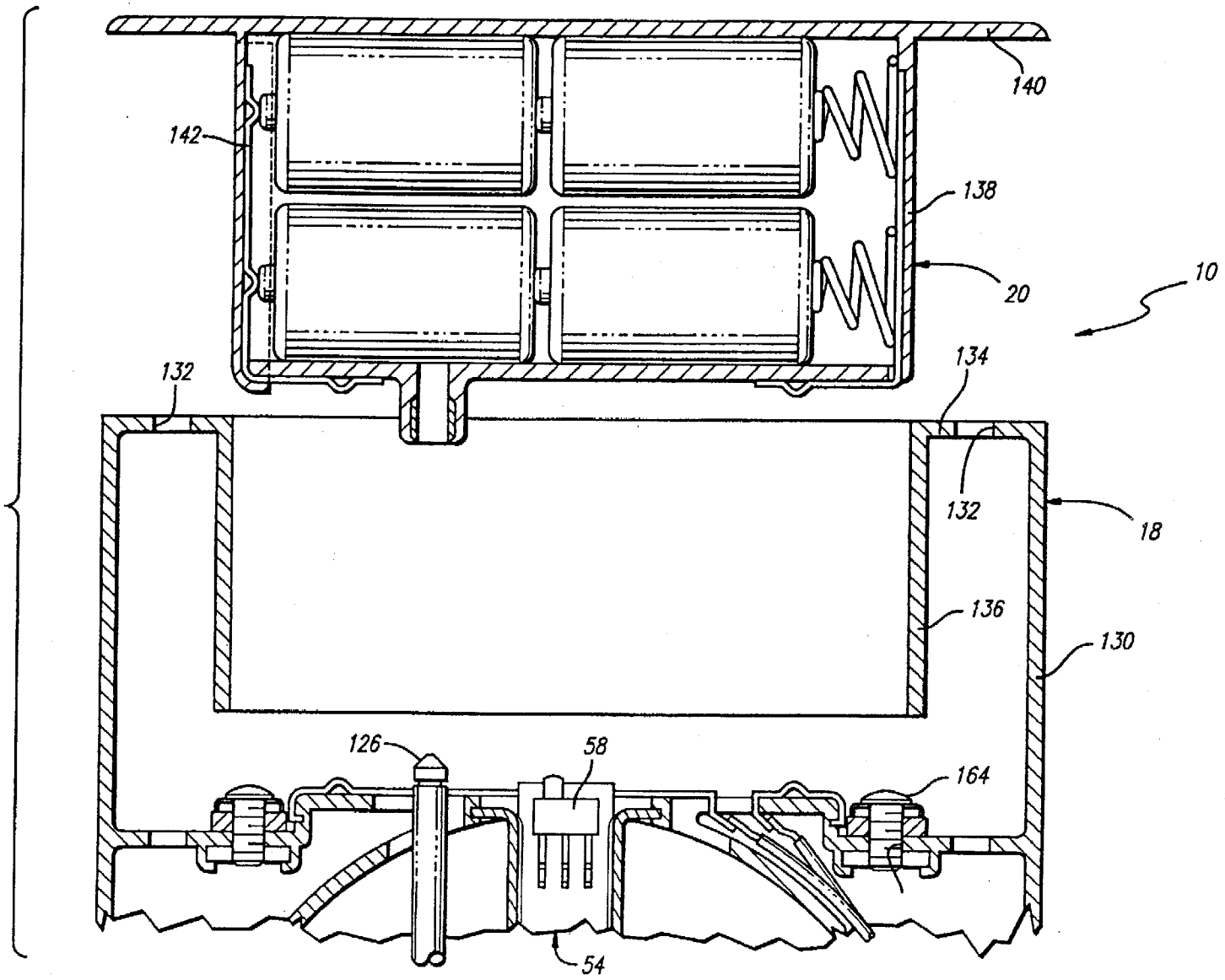
FIG. 7 is an enlarged exploded fragmentary front elevational view of first and second casings included in the barricade warning light and shows components included in each of the casings and particularly shows an arrangement for holding batteries in a particular one of the casings.

The light emitting diodes 38 are disposed on an electronic module which may span the lens diameters generally indicated at 54 in FIGS. 3 and 7, between the lenses 24. The integrated circuit chip 50 (FIG. 3) is also disposed on the electronic module 54 as is a photocell 56. The photocell 56 detects the time between the onset of dusk and the onset of dawn and produces a signal during such time period. This signal is introduced to the CMOS chip 50 to energize the light emitting diodes 38.

A switch 58 is also disposed on the electronic module 54 and is connected electrically to the CMOS chip 50. The switch 58 has two (2) states of operation. In one state of the switch 58, the light emitting diodes 38 are energized continuously during the period between the onset of dusk and the onset of dawn. In the other state of the switch 58, the light emitting diodes 38 are energized periodically during the period between the onsets of dusk and dawn.

The electronic module 54 is disposed in the casing 18. The casing 18 includes a pair of spaced bottom walls 60 and 62 with a first pair of aligned holes 66, a second pair of aligned holes 68, a third pair of aligned holes 70 and a fourth pair of aligned holes 72. A base plate 74 made from a suitable material such as steel is disposed in the space between the walls 60 and 62 and is provided with holes at positions as necessary, such positions being aligned with the holes 66, 68, 70 and 72.

A stanchion portion 76 (FIG. 3) is provided in integral, but vertically spaced, relationship with the bottom wall 62. A yoke member 78 (which may be considered as a coupling member) preferably having a planar configuration is disposed in the space between the bottom wall 62 and the stanchion portion 76. The yoke member 78 is biased toward the left in FIG. 1 as by a helical spring 79. The yoke member 78 is provided at its left end with a yoke 80 which engages a groove in a support rod 82 and provides a secure mounting of the barricade light assembly to the support rod 82.

In one embodiment, a suitably configured key 84 (FIG. 3) may be extended through the holes 70 in the walls 60 and 62 from a position external to the casing 18 to engage a keyhole 77 in the yoke member 78 and move the yoke member to the right against the constraint of the spring 79. In this way, the support rod 82 is released from engagement with the casing 18. The support rod 82 may be attached as by a tamper-proof nut-and-bolt assembly 86 (FIGS. 2 and 6) to the barricade 12 at a position where a pair of obliquely disposed legs 88 (FIGS. 1, 2 and 6) on the barricade converge. The legs 88 are disposed on the ground. In this way, the key 84 may be extended through the hole 70 to attach the casing 18 to, or detach the casing from, the support rod 82, which may be considered to be included in the barricade 12.

An on-off switch generally indicated at 90 (FIG. 3) is attached to the casing 18 at a position near the bottom of the casing. The switch 90 is in alignment with the holes 72 in the bottom walls 60 and 62. The switch 90 includes an actuatable button 92 which faces downwardly toward the holes 72. The button 92 may be actuated by inserting the key 84 through the holes 72 and actuating the switch. In each alternate actuation of the button 92, the barricade warning light 10 becomes active or "on". In the other actuations of the button 92, the barricade warning light 10 becomes inactive or "off". Leads 94 extend from the switch 90 to the switch 58 and to batteries in the casing 20.

In one embodiment, the casing 18 has side walls 98 (FIG. 3). Braces 102 may extend from the side walls 98 at an intermediate position in the height of the side walls 98 to annular portions of the lenses 104. The annular portions of the lenses 104 are integral with each other at their bottom ends and with the stanchion portion 76. The annular portions of the lenses 104 define at their bottom end a socket 106 for receiving and holding one end of the electronic module 54. At its top end, the electronic module 54 has a flange 110 which is seated in a socket 112 in a thickened portion 114 integral with a horizontal wall 116 of the casing 18. The flange 110 may be unseated from the socket 112 and removed when the halves of the casing 18 are separated.

Figure 10:
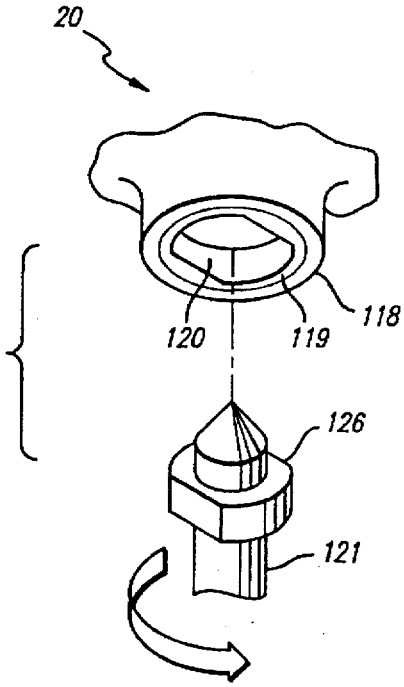
FIG. 10 is a fragmentary exploded perspective view of an arrangement for separating the first and second casings from a position outside the casings.

In one embodiment, the casing 20 has a bushing portion 118 with a hole 120 in alignment with an actuating rod 121 (FIGS. 3 and 10). The hole 120 may contain a retaining insert 119 capable of engaging with mating tip 126, which may be considered a coupling member of the actuating rod 121. The opposing end of the actuating rod is located internally to the casing 18 and in alignment with the holes 68. The key 84 may be extended through the hole 68 to engage the actuating rod 121. Rotation of the key 84 and the actuating rod 121 to the first position securely engages the mating tip 126 of the retainer insert 119, thus coupling the second casing 20 to the first casing 18. Rotation of the key 84 and the actuating rod 121 to the second position causes the casing 20 to be separated from casing 18.

In one embodiment, the casing 18 has an upright portion 130 (FIGS. 3 and 7) which extends above the wall 116 of the casing 18 at the annular periphery of the casing. Apertures 132 are provided in a horizontal wall 134 defining the top of the upright 130. A wall 136 extends vertically downwardly from the horizontal wall 130 at the inner end of the horizontal wall 134 to define the inner periphery of the upright portion 130. The wall 136 abuts and supports a downwardly extending wall 138 at one side of the casing 20. The casing 20 has a top wall 140 which rests on the horizontal wall 134 defining the top of the upright portion 130.

In one embodiment, a snap-on retaining cap 142 may be provided on one side of the casing 20. The cap 142 presses a resilient battery contact 144 (FIG. 3) against the positive terminals of a pair of batteries 145. The negative terminals of the batteries 145 engage the positive terminals of a pair of batteries 146. The negative terminals of the batteries 146 engage first ends of a pair of resilient conductive springs 148. The other ends of the springs 148 are in turn disposed against a battery contact 150 which abuts the side wall 138 on the casing 20.

Figure 8:
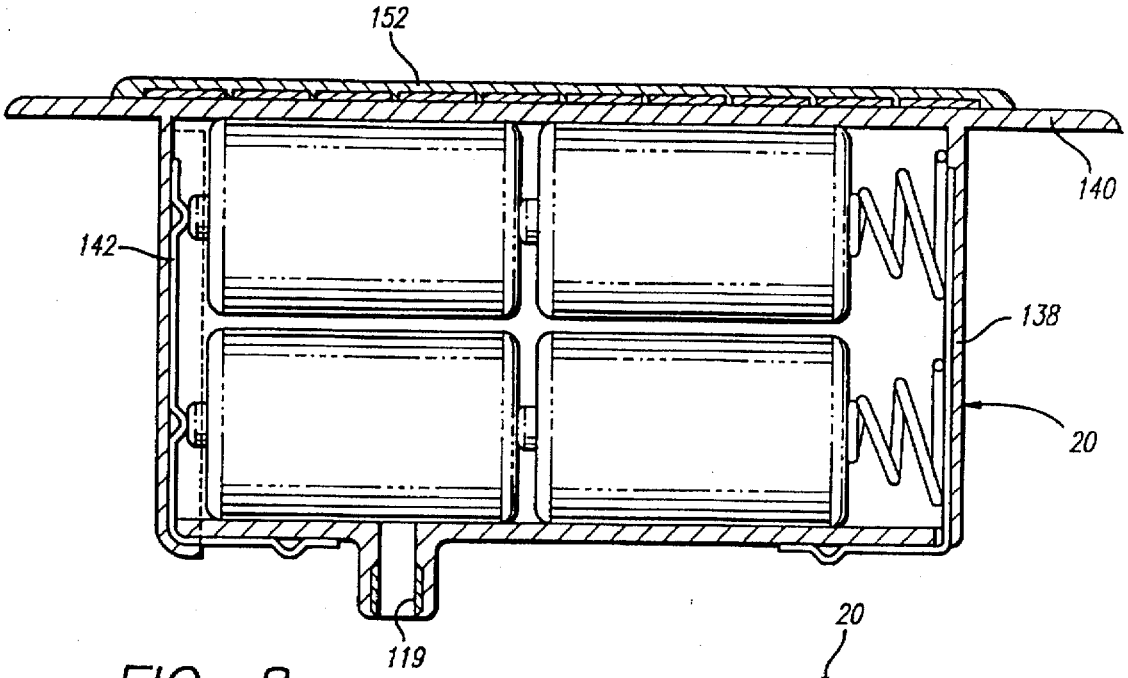
FIG. 8 is an enlarged front elevational view of a modification of the second casing also shown in FIG. 7 and also shows the batteries in the second casing and an optional solar regulation panel arrangement for recharging the batteries utilized in the second casing.

The batteries 145 and 146 may constitute high quality alkaline batteries containing reduced harmful waste products. These may be "green" or environmentally compatible batteries. An indicator 152 (FIG. 2) may be provided in the casing 18 to show the amount of power remaining in the batteries 145 and 146. In one embodiment (FIG. 8), a solar panel 152 formed in a conventional manner may be disposed on the external surface of the top wall 140 of the casing 20 to provide an alternate source of energy for extending the life of the now rechargeable batteries 145 and 146. When the solar panel 152 is disposed on the casing 20, the batteries 145 and 146 may constitute nickel cadmium batteries. The solar panel embodiment (FIG. 8) is fully field optional and interchangeable with the non-solar panel embodiment (FIG. 7).

In one embodiment, clamping fasteners 154 (FIG. 3) may be provided to capture the base plate 74 within the space formed by the bottom walls 60 and 62 of the casing halves. The clamping fasteners 154 are hidden and inaccessible when the casing 20 is attached to the assembled halves of the casing 18. However, when the casing 20 is separated from the casing 18, the fasteners 154 become accessible through the apertures 132 in the top wall 134 of the upright portion 130 and through apertures 155 in the horizontal wall 116 and apertures 157 in the braces 102. A standard screw or hex driver can then be inserted through the apertures 132, 155 and 157 to screw the clamping fasteners 154 into the bottom walls 60 and 62, thereby capturing the base plate 74, or to unscrew the clamping fasteners from the bottom walls, thereby providing for the separation of the casing halves and the release of the base plate.

Clamping fasteners 164 (FIGS. 3 and 7) are also hidden and inaccessible when the casing 20 is attached to the casing 18. However, upon the removal of the casing 20 from the casing 18, the clamping fasteners 164 become visible and accessible. The clamping fasteners 164 can then be screwed into retention members 166, thus clamping the walls 116 and 162 and retaining the two halves of the first casing 18 in an abutting relationship. Alternatively, the clamping fasteners 164 can be unscrewed from the retention members 166 to allow separation of the first casing halves. A standard screw driver can be used since the clamping fasteners 164 are directly accessible.

The barricade warning light 10 has certain important advantages. It provides an increased visibility relative to the barricade warning lights of the prior art. This results in part from the provision of the Fresnel lens defined by the annular ridges 28 and the grooves 30 on one surface of the lenses 24 and from the pillow lenses 32 on the other surface of the lenses. It also results in part from the provision of the specific bulbous configuration 34 at the center of each of the lenses 24, from the provision of the pillow lens 36 in each of the bulbous configurations and from the direction of light from the light-emitting diodes 38 to the centers of the specific bulbous configurations 34 in the lenses. Even though the barricade warning light 10 provides enhanced visibility, it consumes a reduced amount of power. The barricade warning light 10 is also advantageous in providing increased areas of the retroreflective material 22 in comparison to the barricade warning lights of the prior art.

The barricade warning light 10 has other important advantages. It is inaccessible except to authorized personnel. This results from the fact that the assembly of casings 18 and 20 provides a complete enclosure. When the casings 18 and 20 provide such an enclosure, the key 84 can be inserted through holes in the casing 18 to operate the on-off switch 90, to assemble the support rod 82 to the casing or remove the support rod from the casing and to provide for a coupling of the casing 20 to the casing 18 or for a decoupling of the casing 20 from the casing 18.

When the casing 20 is removed from the casing 18, the batteries 145 and 146 can be easily replaced. This feature is enhanced by the provision of the sensor 152 for showing the amount of power remaining in the batteries 145 and 146. The easy removability of the casing 20 from the casing 18 also allows easy replacement of the casing 20 as a unit and easy replacement of other components or sub-assemblies such as the electronic module 54.

Figure 12:
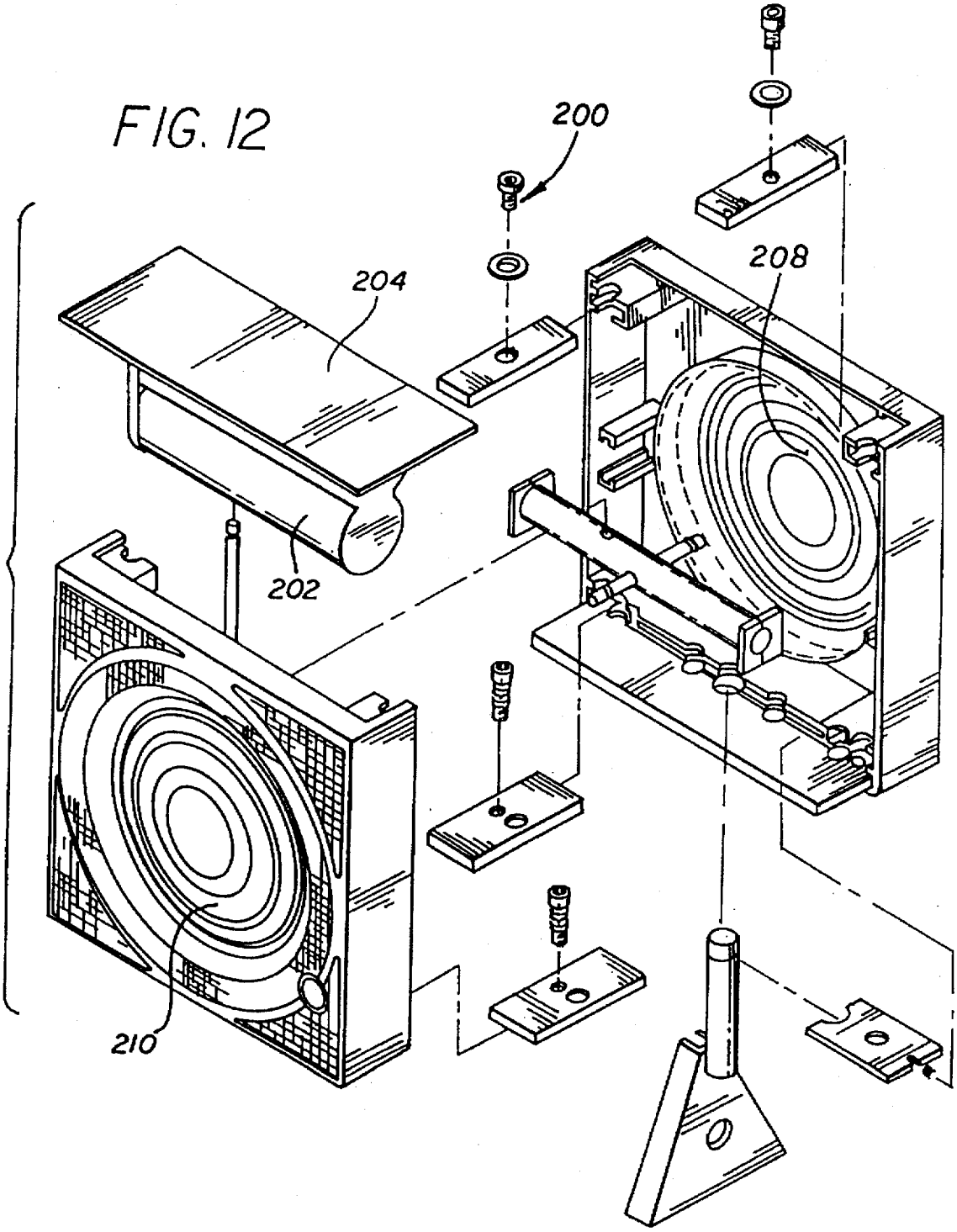
FIG. 12 is an exploded perspective view of a second embodiment of the invention, this embodiment having a shorter height and a greater width than the embodiment shown in the previous Figures.

FIG. 12 shows a second embodiment, generally indicated at 200, of the invention. This embodiment is shorter than the embodiment shown in the previous Figures and described above. However, it has a greater width than the embodiment shown in the previous Figures and described above. This results from the suspension of batteries 202 downwardly from a top casing 204 and the disposition of batteries 206 between a pair of lenses 208 corresponding to the lenses 24 in the previous embodiment.

Figure 13:
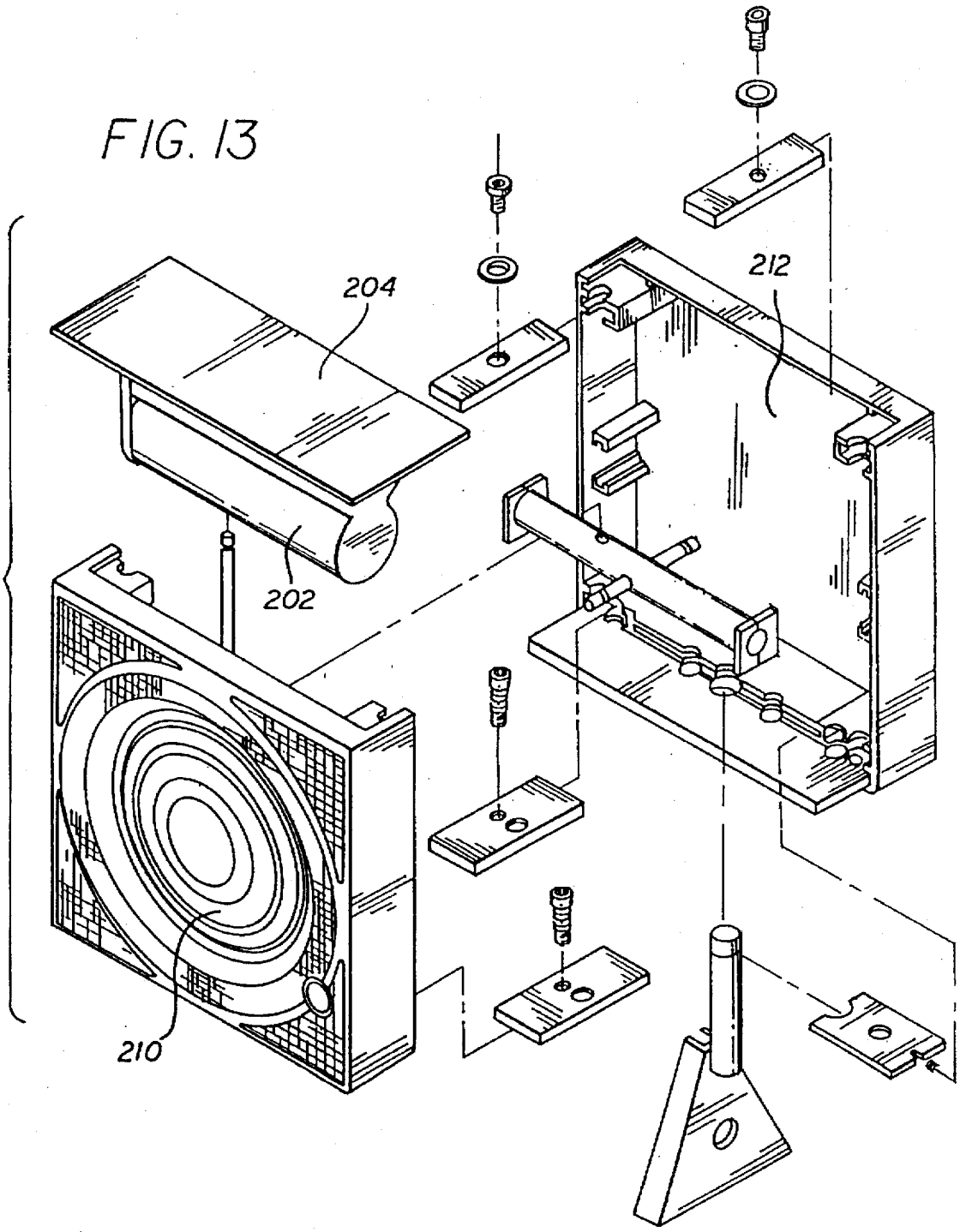
FIG. 13 is a sectional view of an additional embodiment of the invention, this embodiment including a single lens and a single, light emitting diode for directing light only in a particular direction.

FIG. 13 shows a third embodiment in which only a single lens 210 corresponding to one of the lenses 24 is included. Instead of the second lens as in the previous embodiments, a wall 212 is provided. In this way, the embodiment shown in FIG. 13 directs light only in a single direction rather than in two (2) opposite directions as in the embodiments shown in the previous Figures and described above.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. In combination in a barricade warning light, first means defining a casing, lens means disposed in the casing for transmitting light from the casing in a particular direction, means disposed in the casing for directing light to the lens means for the transmission of light by the lens means from the casing in the particular direction, a switch disposed in the casing and operative to control the transmission of light by the light-transmitting means to the lens means, there being an opening in the casing for the passage of a key through the opening from a position external to the casing to operate the switch, the lens means including a pair of lenses, each of the lenses having a substantially conical shape and disposed in an abutting back-to-back relationship with the other one of the lenses and the light-directing means being disposed between the lenses for the direction of light to a central position on each of the lenses, the opening in the casing constituting a first opening, an electronic module disposed in the casing for holding the light-directing means, coupling means disposed relative to the electronic module and the casing for holding the electronic module in the casing in a fixed relationship with the casing in a first operative relationship and for releasing the electronic module from the casing in a second operative relationship different from the first operative relationship, switch means supported by the electronic module, the switch means having first and second operative relationships and operative in the first relationship to provide for a continuous illumination of the light-directing means and operative in the second relationship to provide for a periodic illumination of the light-directing means, and means operatively coupled to the light-directing means for obtaining an operation of the light-directing means by the switch means in an individual one of the first and second operative relationships only during the occurrence of darkness in each 24-hour period, the lens means including a pair of lenses, each of the lenses in the pair defining a Fresnel lens on one surface to produce conical rays and defining a plurality of pillow lenses on the other surface to to produce rays divergent at a particular angle, and light-reflective material disposed on the casing in the areas surrounding the lenses to reflect the light from headlights of approaching vehicles.

2. In combination in a barricade warning light, first casing, lens means disposed in the casing for transmitting light from the first casing in a particular direction, means disposed in the first casing for directing light to the lens means for the transmission of the light from the first casing in the particular direction, a second casing, the second casing being operatively coupled to the first casing in a first relationship and being disposed for uncoupling from the first casing in a second relationship different from the first relationship, and coupling means disposed in the first casing and having first and second operative relationships and operative in the first relationship to provide a locking of the second casing to the first casing and operative in the second relationship to provide an unlocking of the second casing from the first casing, there being an opening in the first casing for providing a controlled operation of the coupling means in the first relationship at first particular times from a position external to the first casing and for providing a controlled operation of the coupling means, from the position external to the first casing, in the second relationship at second particular times different from the first particular times.

3. In a combination as set forth in claim 2, a plurality of batteries disposed in the second casing and connected to the light-directing means for energizing the light-directing means.

4. In a combination as set forth in claim 2, the lens means including a pair of lenses, each of the lenses having a substantially concave convex shape and being disposed in a back-to-back relationship with the other one of the lenses and the light-directing means constituting a pair of light-directing means each associated with an individual one of the lenses and the individual light-directing means for each lens being disposed between the lenses for the direction of light to a central position on each of the lenses.

5. In a combination as set forth in claim 2, the first casing and the second casing being constructed to define an enclosure, in the first operative relationship of the control means, inaccessible from a position external to the casings other than through the opening in the first casing.

6. In a combination as set forth in claim 2, means in the first casing for detecting the onset of daytime and the onset of nighttime, and means in the first casing for providing for an energizing of the light-directing means upon the onset of nighttime and until the onset of daytime.

7. In a combination as set forth in claim 5, a plurality of batteries disposed in the second casing and connected to the light-directing means for energizing the light-directing means, the lens means include a pair of lenses, each of the lenses having a substantially conical shape and disposed in a back-to-back relationship with the other one of the lenses and the light-directing means being disposed between the lenses for the direction of light to a central position on each of the lenses, the first casing and the second casing being constructed to define an enclosure, in the first operative relationship of the control means, inaccessible from a position external to the casings other than through the opening in the first casing.

8. In combination in a barricade warning light, a casing, an electronic module disposed in the casing, a support rod assembly, coupling means having first and second operative relationships and operatively coupled to the support rod assembly and the casing in the first relationship for fixedly positioning the support rod assembly within the casing and operative in the second relationship to uncouple the support rod assembly from the casing, means disposed within the casing for supporting the electronic module within the casing, lens means disposed within the casing for transmitting light from the casing, and means disposed within the casing for directing light to the lens means for the transmission of light from the casing, there being an opening in the casing to provide for an operation of the coupling means in the casing in the first relationship at first particular times from a position external to the casing and for an operation of the coupling means in the second relationship from the external position at second particular times different from the first particular times.

9. In a combination as set forth in claim 8, means supported by electronic module for detecting the onset of daytime and the onset of the nighttime, and means responsive to the detecting means for energizing the light-directing means upon the onset of nighttime and until the onset of daytime.

10. In a combination as set forth in claim 9, the light-directing means including a light-emitting diode and including electrical circuitry coupled to the light-emitting diode and to the detecting means for energizing the light-emitting diode upon the onset of nighttime and until the onset of daytime.

11. In a combination as set forth in claim 10, a switch supported by the electronic module and having first and second operative relationships and operative in the first relationship to provide for a continuous energizing of the light-emitting diode during the period of time between the onset of nighttime and the onset of daytime as determined by the detecting means and operative in the second relationship to provide for an intermittent energizing of the light-emitting diode during the period of time between the onset of nighttime and until the onset of daytime as determined by the detecting means.

12. In a combination as set forth in claim 8, the lens means including a pair of lenses, each of the lenses having a substantially concave convex shape and being disposed in a back-to-back relationship with the other one of the lenses and the light-directing means being disposed between the lenses for the direction of light to a central position on each of the lenses.

13. In a combination as set forth in claim 8 for use with a barricade, the support rod assembly extending outside of the casing, and means on the support rod for providing for a releasable coupling of the support rod to the assembly barricade.

14. In a combination as set forth in claim 11, the lens means including a pair of lenses, each of the lenses having a substantially concave convex shape and being disposed in an abutting back-to-back relationship with the other one of the lenses and the light-directing means being disposed between the lenses for the direction of light to a central position on each of the lenses, the support rod extending outside of the casing, and means on the support rod assembly for providing for a permanent attachment of the support rod assembly to the barricade and a releasable coupling of the support rod assembly to the casing.

15. In combination in a barricade warning light, a casing, a support rod disposed in the casing, coupling means having first and second operative relationships and operatively coupled to the support rod and the casing in the first relationship for fixedly positioning the support rod within the casing and operative in the second relationship to uncouple the support rod from the casing, lens means disposed within the casing for transmitting light from the casing, there being an opening in the casing to provide for an operation of the coupling means in the casing in the first relationship at first particular times from a position external to the casing and for an operation of the coupling means in the second relationship from the external position at second particular times different from the first particular times.

16. In a combination as set forth in claim 15 for use with a barricade, the support rod extending outside of the casing, and means on the support rod for providing for a coupling of the support rod to the barricade.

17. In a combination as set forth in claim 15, the lens means including a pair of lenses, each of the lenses having a substantially concave convex shape and being disposed in a back-to-back relationship with the other one of the lenses and the light-directing means being disposed between the lenses for the direction of light to a central position on each of the lenses.

18. In a combination as set forth in claim 15, the coupling means including a member disposed in the casing and including a yoke disposed at one end and biased into engagement with the rod and movable to a position disengaging the yoke from the rod and including means disposed in the member and operable through the opening from a position external to the casing to move the member, against the action of the biasing, in a direction for disengaging the yoke from the rod.

19. In a combination as set forth in claim 15, means disposed within the casing for detecting the onset of daytime and the onset of nighttime, and means disposed within the casing for energizing the light-directing means during the period of time between the detection of the onset of nighttime and the onset of daytime.

20. In a combination as set forth in claim 18 for use with a barricade, the support rod extending outside of the casing, and means on the support rod for providing for a coupling of the support rod to the barricade, the lens means including constituting a pair of lenses, each of the lenses having a substantially concave convex shape and being disposed in a back-to-back relationship with the other one of the lenses and the light-directing means being disposed between the lenses for the direction of light to a central position on each of the lenses, means disposed within the casing for detecting the onset of daytime and the onset of nighttime, and means disposed within the casing for energizing the light-directing means during the period between the detection of the onset of nighttime and the onset of daytime.

21. In combination in a barricade warning light, a first casing, a second casing removably coupled to the first casing and defining an inaccessible enclosure with the first casing when the second casing is coupled to the first casing, there being an opening in the first casing for providing in a first relationship, from a position external to the first casing, for a coupling of the second casing to the first casing and for providing, in a second relationship different from the first relationship, from the external position for the decoupling of the second casing from the coupled relationship with the first casing, and an electronic module disposed within the first casing for removal from the first casing when the first casing becomes decoupled form the second casing, the electronic module being constructed to produce a light when energized.

22. In a combination as set forth in claim 21, batteries disposed in the second casing in inaccessible relationship to the second casing when the second casing is coupled to the first casing, the second casing being constructed to provide for a replacement of the batteries when the second casing is decoupled from the first casing.

23. In a combination as set forth in claim 21, means supported by the electronic module for detecting the onset of daytime and the onset of nighttime, the light display means being responsive to the detecting means for providing an energizing of the light display means upon the onset of nighttime and until the onset of daytime.

24. In a combination as set forth in claim 23, the light-transmitting means including a light-emitting diode and including electrical circuitry coupled to the light-emitting diode and to the detecting means for energizing the light-transmitting diode upon the onset of nighttime and until the onset of daytime.

25. In a combination as set forth in claim 24, a switch supported by the electronic module and having first and second operative relationships and operative in the first relationship to provide for a continuous energizing of the light-emitting diode during the period of time between the onset of nighttime and the onset of daytime as determined by the detecting means and operative in the second relationship for providing for an intermittent energizing of the light-emitting diode during the period of time between the onset of nighttime and the onset of daytime as determined by the detecting means.

26. In combination in a barricade warning light, a first casing, a second casing defining an enclosure with the first casing, means disposed in the first casing for providing a light illumination and a transmission of the light illumination from the casing, means disposed in the second casing for providing energy for energizing the light illumination means, and coupling means disposed in the first casing and having first and second operative relationships and operatively coupled to the first and second casings in the first relationship to retain the casings in a fixed relationship to each other and for decoupling the first and second casings in the second relationship, the coupling means being constructed to be moved between the first and second relationships, there being an opening in the first casing for the insertion of a key into the opening to move the coupling means from a position external to the first casing between the first and second relationships.

27. In a combination as set forth in claim 26, means disposed on an external surface of the second casing for receiving solar power for introduction to the light illumination means.

28. In a combination as set forth in claim 26, a support rod assembly disposed within the first casing at a first end and extending from the first casing at a second end opposite the first end, the coupling means constituting first coupling means, second means disposed in the first casing and having first and second operative relationships and operative in the first relationship to retain the first end of the support rod assembly in a fixed disposition within the casing and operative in a second relationship to provide for an uncoupling of the first end of the support rod from the casing, the opening in the first casing constituting a first opening, there being a second opening in the first casing for the insertion of the key into the second opening from a position external to the first casing to move the second coupling means between the first and second operative relationships.

29. In a combination as set forth in claim 26, a switch disposed in the first casing and having first and second operative relationships and operative in the first relationship to provide for an energizing of the light illumination means and operative in the second relationship to prevent such a light illumination, the opening in the first casing constituting a first opening, there being a second opening in the casing for the insertion of the key into the second opening from a position external to the first casing to operate the switch between the first and second operative relationships.

30. In a combination as set forth in claim 26, the light illumination means including light emitting diode means and means for energizing the light emitting diode means and a pair of lenses each constructed on one surface to produce a beam of light with converging rays in response to the light from the light emitting diode means and constructed on the other surface to convert such beam of light to a particular pattern, the lenses being disposed in a back-to-back relationship with the light-emitting diode means being disposed between the lenses.

31. In a combination as set forth in claim 30, means disposed on an external surface of the second casing for receiving solar power for introduction to the light illumination means, a support rod assembly disposed within the casing at a first end and extending from the first casing at a second end opposite the first end, the coupling means constituting first coupling means, second means disposed in the first casing and having first and second operative relationships and operative in the first relationship to retain the first end of the support rod assembly in a fixed disposition within the casing and operative in a second relationship to provide for an uncoupling of the first end of the support rod from the casing, the opening in the first casing constituting a first opening, there being a second opening in the first casing for the insertion of the key into the second opening to move the second coupling means between the first and second operative relationships from the position external to the first casing, a switch disposed in the first casing and having first and second relationships and operative in the first relationship to provide for an energizing of the light illumination means and operative in the second relationship to prevent such a light illumination, there being a second opening in the first casing for the insertion of the key into the second opening from a position external to the first casing to operate the switch between the first and second operative relationships.

32. In a combination as set forth in claim 26, an electronic module disposed in the first casing and having first and second relationships and operatively coupled to the first casing in the first relationship and decoupled from the second casing in the second relationship for removal from the first casing, the electronic module being positioned, with the removal of the second casing from the first casing, for a change between the first and second relationships with respect to the first casing, and the light illumination means including a member disposed on the electronic module for generating light.

33. In combination in a barricade warning light, a casing, a support rod assembly disposed at one end in the casing and extending from the casing at a second end opposite the first end, coupling means disposed in the casing and having first and second operative relationships and operative in the first relationship to retain the support rod assembly in a fixed relationship in the casing and operative in the second relationship to provide for an uncoupling of the support rod assembly from the casing, there being an opening in the casing for the insertion of a key into the opening from a position external to the first casing to move the coupling means between the first and second relationships, and means disposed in the casing for providing a light illumination and a transmission of the light illumination from the casing.

34. In a combination as set forth in claim 33, use with a barricade, means disposed on the support rod assembly at a position external to the casing for providing an attachment of the support rod assembly to the casing.

35. In a combination as set forth in claim 33, a switch disposed in the casing and having first and second relationships and operative in the first relationship to provide for an energizing of the light illumination means and operative in the second relationship to prevent such a light illumination, the opening in the casing constituting a first opening, there being a second opening in the casing for the insertion of the key into the second opening from a position external to the casing to operate the switch between the first and second operative relationships.

36. In a combination as set forth in claim 33, the light illumination means including a pair of lenses disposed in a back-to-back relationship, each of the lenses being constructed to receive light at a central position and to produce light rays extending in a substantially parallel direction from the lenses, the light illuminating means including light emitting diodes disposed between the lenses to direct light to the central positions in the lenses.

37. In a combination as set forth in claim 33, a electronic module disposed at one end in the casing and extending at an opposite end from the casing, the light illuminating means including a light emitting diode disposed on the electronic module and including circuitry disposed on the electronic module for energizing the light emitting diode and including a photocell disposed on the electronic module for activating the circuitry when the area surrounding the photocell is dark.

38. In combination in a barricade warning light, a first casing, a pair of lenses disposed in the casing in a back-to-back relationship for transmitting light from the first casing in a particular direction, means disposed in the first casing for directing light to the lenses for the transmission of the light by the lenses from the first casing in the particular direction, a second casing, the second casing being operatively coupled to the first casing in a first relationship and being disposed for uncoupling from the first casing in a second relationship different from the first relationship, at least one battery supported by the second casing between the lenses in the first relationship of the first casing and the second casing, coupling means disposed in the first relationship and having first and second operative relationships and operative in the first relationship to provide a locking of the second casing to the first casing and operative in the second relationship to provide an unlocking of the second casing from the first casing, there being an opening in the first casing for providing a controlled operation of the coupling means in the first relationship at first particular times from a position external to the first casing through the opening and for providing a controlled operation of the coupling means through the opening, from the position external to the first casing, in the second relationship at second particular times different from the first particular times.

39. In a combination as set forth in claim 38, the first casing and the second casing being constructed to define an enclosure, in the first operative relationship of the control means, inaccessible from a position external to the casings other than through the opening in the first casing.

40. In a combination as set forth in claim 38, the opening in the first casing constituting a first opening, a switch disposed in the first casing and having first and second states of operation to obtain an operation of the light-directing means in the first relationship and to prevent an operation of the light-directing means in the second relationship, there being a second opening in the first casing for providing a controlled operation of the switch in the first relationship through the second opening at first particular times and a controlled operation of the switch in the second relationship through the second opening at second particular times different from the first particular times.

41. In a combination as set forth in claim 38 wherein the barricade includes a mounting rod assembly, the opening in the first casing constituting a first opening, means for releasably coupling the first casing to the mounting rod assembly, there being a second opening in the first casing for providing for a coupling of the first casing to the mounting rod assembly through the second opening at first particular times and a decoupling of the first casing from the mounting rod assembly through the second opening at second particular times different from the first particular times.

42. In a combination as set forth in claim 41, a switch disposed in the first casing and having first and second states of operation to obtain an operation of the light-directing means in the first relationship and to prevent an operation of the light-directing means in the second relationship, there being a third opening in the first casing for providing a controlled operation of the switch in the first relationship through the third opening at first particular times and a controlled operation of the switch in the second relationship through the third opening at second particular times different from the first particular times, and the first casing and the second casing being constructed to define an enclosure, in the first operative relationship of the control means, inaccessible from a position external to the casings other than through the opening in the first casing.

43. In combination in a barricade warning light, a first casing, a lens disposed in the casing for transmitting light from the first casing in a particular direction, means disposed in the first casing for directing light to the lens for the transmission of the light by the lens from the first casing in the particular direction, a second casing, the second casing being operatively coupled to the first casing in a first relationship and being disposed for uncoupling from the first casing in a second relationship different from the first relationship, at least one battery supported by the second casing, coupling means disposed in the first relationship and having first and second operative relationships and operative in the first relationship to provide a locking of the second casing to the first casing and operative in the second relationship to provide an unlocking of the second casing from the first casing, there being an opening in the first casing for providing a controlled operation of the coupling means in the first relationship at first particular times from a position external to the first casing through the opening and for providing a controlled operation of the coupling means, from the position external to the first casing through the opening, in the second relationship at second particular times different from the first particular times.

44. In a combination as set forth in claim 43, the opening in the first casing constituting a first opening, a switch disposed in the first casing and having first and second states of operation to obtain an operation of the light-directing means in the first relationship and to prevent an operation of the light-directing means in the second relationship, there being a second opening in the first casing for providing for a controlled operation of the switch in the first relationship through the second opening at first particular times and a controlled operation of the switch in the second relationship through the second opening at second particular times different from the first particular times.

45. In a combination as set forth in claim 43 wherein the barricade includes a mounting rod assembly, the opening in the first casing constituting a first opening, means for releasably coupling the first casing to the mounting rod assembly, there being a second opening in the first casing for providing for a coupling of the first casing to the mounting rod assembly through the second opening at first particular times and a decoupling of the first casing from the mounting rod assembly through the second opening at second particular times different from the first particular times.

46. In a combination as set forth in claim 45, a switch disposed in the first casing and having first and second states of operation to obtain an operation of the light-directing means in the first relationship and to prevent an operation of the light-directing means in the second relationship, there being a third opening in the first casing for providing a controlled operation of the switch in the first relationship through the third opening at first particular times and a controlled operation of the switch in the second relationship through the third opening at second particular times different from the first particular times.

* * * * *